US005318131A

United States Patent [19]

Baker

[11] Patent Number: 5,318,131

[45] Date of Patent: Jun. 7, 1994

[54] HYDRAULICALLY ACTUATED LINER HANGER ARRANGEMENT AND METHOD

[76] Inventor: Samuel F. Baker, P.O. Box 35729, Houston, Tex. 77235-5729

[21] Appl. No.: 934,532

[22] PCT Filed: Apr. 3, 1992

[86] PCT No.: PCT/US92/02497

§ 371 Date: Oct. 6, 1992

§ 102(e) Date: Oct. 6, 1992

[51] Int. Cl.[5] ..... E21B 23/00

[52] U.S. Cl. ..... 166/382; 166/207; 166/217

[58] Field of Search ..... 166/382, 207, 217, 123, 166/124, 181

[56] References Cited

U.S. PATENT DOCUMENTS

| | | | |
|---|---|---|---|
| 3,223,170 | 12/1965 | Mott | 166/208 |
| 4,391,325 | 7/1983 | Baker et al. | 166/208 |
| 4,688,642 | 8/1987 | Baker | 166/382 |
| 4,926,938 | 5/1990 | Lindsey, Jr. | 166/208 |
| 5,038,860 | 8/1991 | Baugh et al. | 166/208 |
| 5,086,845 | 2/1992 | Baugh | 166/382 |

*Primary Examiner*—William P. Neuder
*Attorney, Agent, or Firm*—Jack W. Hayden

[57] ABSTRACT

A liner hanger setting arrangement includes setting tool (T) which supports a piston (P) for engagement with a tubular member (M) moveably supported on the liner (L). At least one cone surface (27) is provided on the member (M). The tubular member (M) is movable by the piston (P) to engage slip segments (26) mounted on the liner (L) to urge the Iv slip segments into securing position with a well bore casing (C). A lock (LM) maintains the cone surface (27) and the slip segments in engaged relation.

30 Claims, 6 Drawing Sheets

HYDRAULICALLY ACTUATED LINER HANGER ARRANGEMENT AND METHOD

STATEMENT OF THE PRIOR ART

Various types of mechanical and hydraulic liner hanger arrangements have been proposed and used for engaging tapered cone segments or surfaces with slips, also referred to as slip segments, to secure a liner in a well casing, so that the liner becomes an extension of the well casing. In some situations, the slip segments are moved up to engage the cone surfaces and in others the cone surfaces are moved down to engage the slip segments which urges the slips to securing relation with the well casing to secure the liner within the casing and depending therefrom. Some setting tools have incorporated pistons for setting hydraulic liner hangers, and thus are removed from the well when the setting tool is removed.

Where the liner and liner hanger are used in a corrosive environment it is preferred that the liners have a high chromium content to attempt to reduce the effects of corrosion. This then requires that all other equipment or components associated with the liner which remain in the well bore be made of high chromium content to reduce the deleterious effects of electrolysis. Increasing the number of liner associated components that require chromium or other alloys may greatly increase the cost of the liner installation. Where the liner hanger employed with the liner is hydraulically actuated, it has been common practice heretofore to provide a port in the liner hanger for actuation of the liner hanger to secure the liner in position. This reduces the pressure integrity of the liner.

Another problem with hydraulic set hangers is that the slips are generally set by a piston that is located above ports which are located in a barrel connected with the liner which subjects members which surround the barrel to pressures which are present in the liner. In most cases, the surrounding member can be heat treated to increase its yield strength to with stand normal or slightly higher well bore pressures, but this does not completely solve the problem, because maintaining the piston seals between the barrel and the surrounding member cannot be assured. If a leak occurs, fluid communication between the inside and outside of the liner is established which is undesirable. Hence, it is desirable to maintain the pressure integrity of the liner and maintain its originally designed and intended strength without creating ports or passages therein which may reduce, or adversely effect the liner wall strength.

U.S. Pat. No. 5,038,860 shows one attempt to overcome the above problem by eliminating the port in the liner and placing it in the setting tool. However, it provides a passage in the wall of the liner substantially through out the longitudinal extent of the liner. Apparently by reason of the size of the passage in the liner wall and to over come the problems of contaminants normally present in well fluid, an isolated fluid chamber is formed between an upper piston and a lower piston. Well fluid pressure on one of the pistons is transmitted through a port in the setting tool to the fluid in the isolated chamber to move a piston sleeve up to push the slips up into engagement with cone segments.

In addition to the cost of forming the above structure, the inherent weakness created in the liner by the passage is apparent. Also, such structure requires that the lower piston, the piston sleeve and other components are not removed with the setting tool, but which remain in the well bore be formed of chromium.

STATEMENT OF THE INVENTION

One object of the present invention is to provide a hydraulic liner hanger setting arrangement which eliminates passages and ports from the liner, maintains the pressure integrity of the liner, and requires that only the liner, the slips and the cones which hang, or support the liner in the well casing, and an outer tubular member on the liner remain in the well casing.

Another object of the invention is to reduce the cost of running alloy liner, and liner hangers, having high chromium content by maintaining the components that remain in the well casing at a minimum.

A further object of the invention is to provide a liner hanger arrangement which can be set by moving a piston in a setting tool down to urge a tubular mandrel on the liner down and move cone segments on the liner into engagement with slip segments on the liner to urge the slip segments into securing relation with the to position the liner on the well casing.

Still another object of the invention is to provide a relatively simple liner hanger setting arrangement and a relatively easy method of setting the arrangement.

Yet a further object of the invention is to provide a method of hanging a liner on a well casing and cementing it by a liner wiper and pump down plug arrangement.

Still another object of the invention is to provide a hydraulically set, mechanical release setting tool for securing a liner with a casing without affecting the pressure integrity of the liner.

Another object is to provide a lock to secure slips on a liner with a casing. Other objects and advantages of the invention will become apparent from the following description and drawings.

DESCRIPTION OF THE PREFERRED EMBODIMENTS

Figure 1:
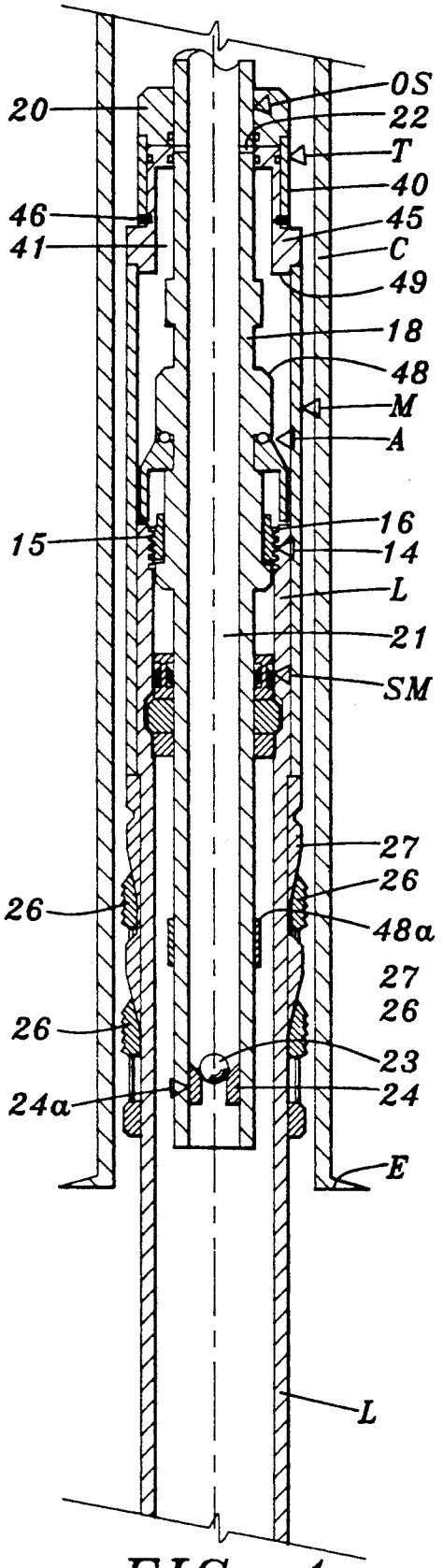
FIG. 1 is a schematic view of a preferred form of the liner hanger setting arrangement of the present invention showing it in running in position and including the running tool, a piston thereon, an outer tubular member, tapered cone surfaces on the tubular member and slips on the liner. A closure is shown in the setting tool to enable fluid to act to move the piston and tubular member down when desired.
Figure 6:
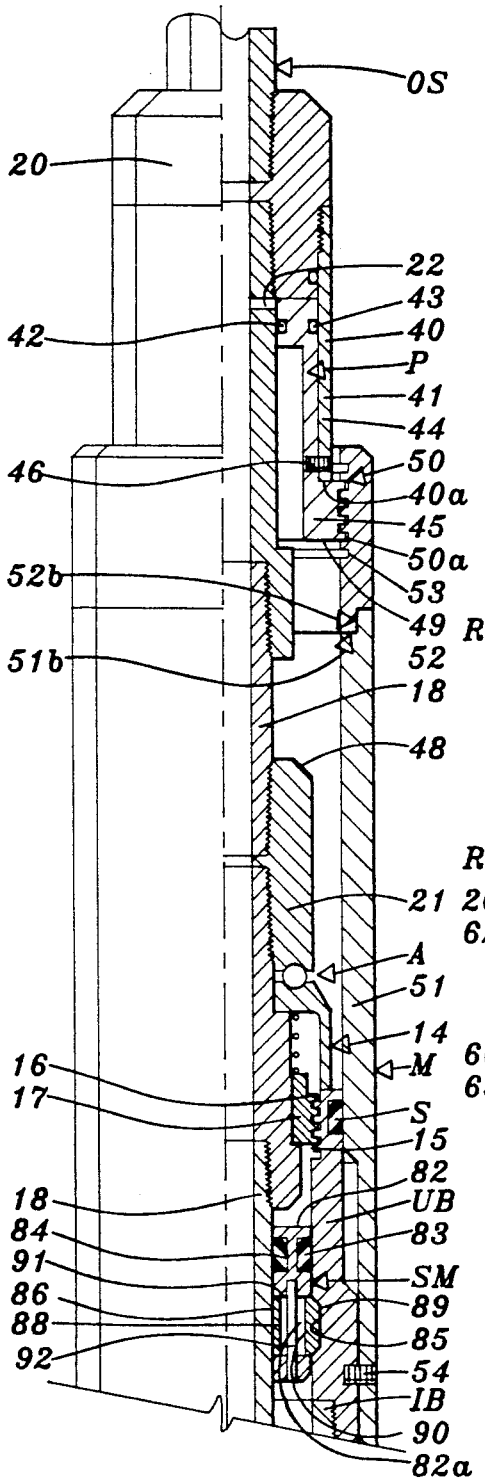
FIG. 6 is a quarter sectional view of the preferred embodiment of the upper portion of the liner hanger setting arrangement of the present invention showing the piston and one form of the sleeve associated therewith.
Figure 8:
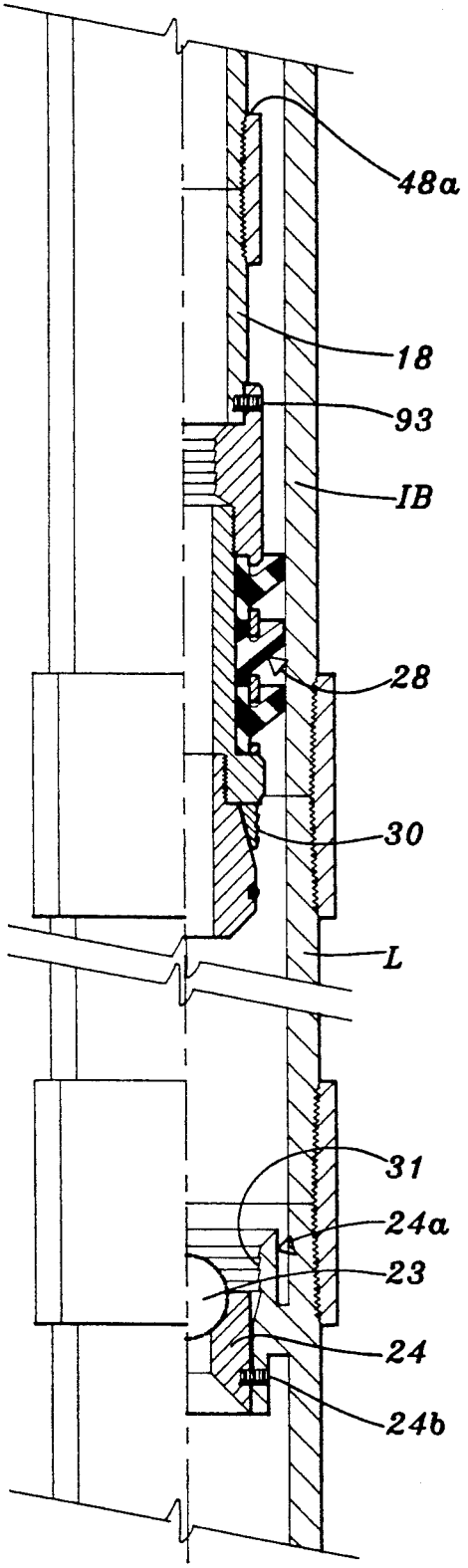
FIG. 8 is a quarter sectional view continuation of FIG. 7 showing the lower portion of the liner hanger setting arrangement.
Figure 9:
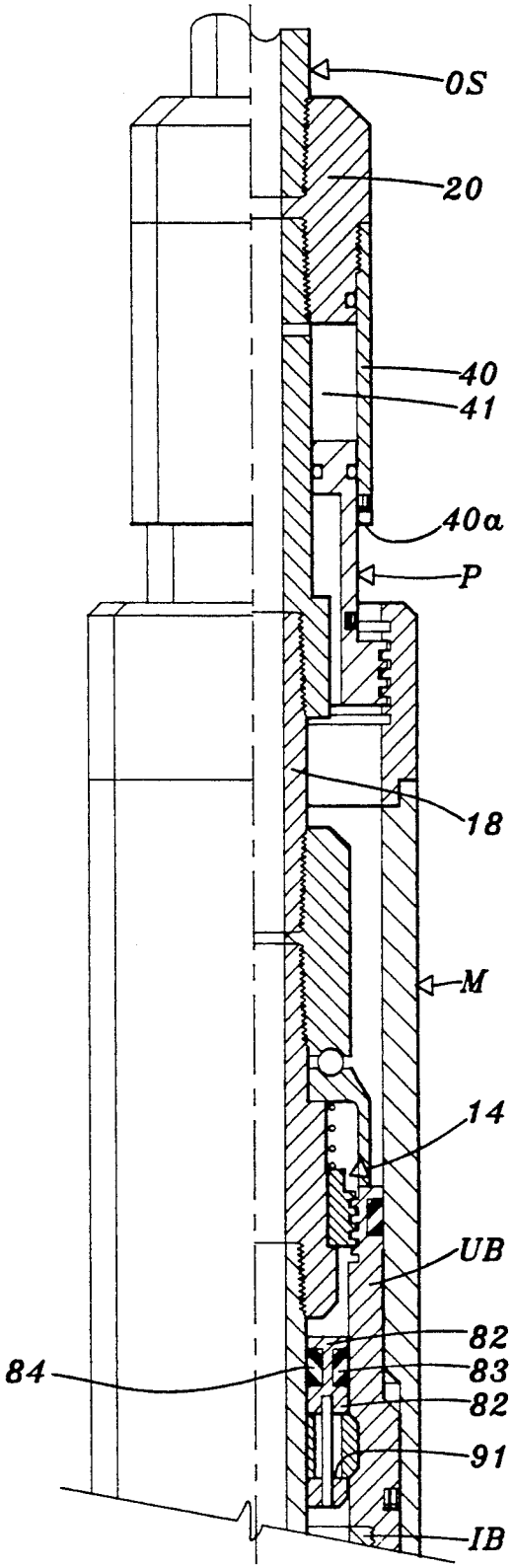
FIG. 9 is a view similar to FIG. 6 showing the piston in the setting tool actuated and the tubular member on the liner moved down.

Attention is first directed to FIG. 1 where a well casing is designated at C which extends into the ground (not shown) with the casing lower end terminating as represented at E. An operating string OS, such as tubing or the like of suitable tubular material and of suitable length extends from the surface of the earth into the casing to the subterranean level or location in the casing in C in the well bore where the liner is to be hung or secured on the casing C. The lower end of the casing is represented at E. In this description, the liner L, as illustrated in FIG. 8, is threadedly connected at its upper end to the inner barrel IB and the inner barrel, as shown in FIG. 6, is connected at its upper end to an upper bushing UB, which upper bushing sealably engages with the seal means SM that extends between the operating string OS and the liner portion UB, as better seen in detail in FIG. 6. It can be appreciated that other tubular components could be connected with and considered as part of the liner, other than that specifically described herein.

Figure 2:
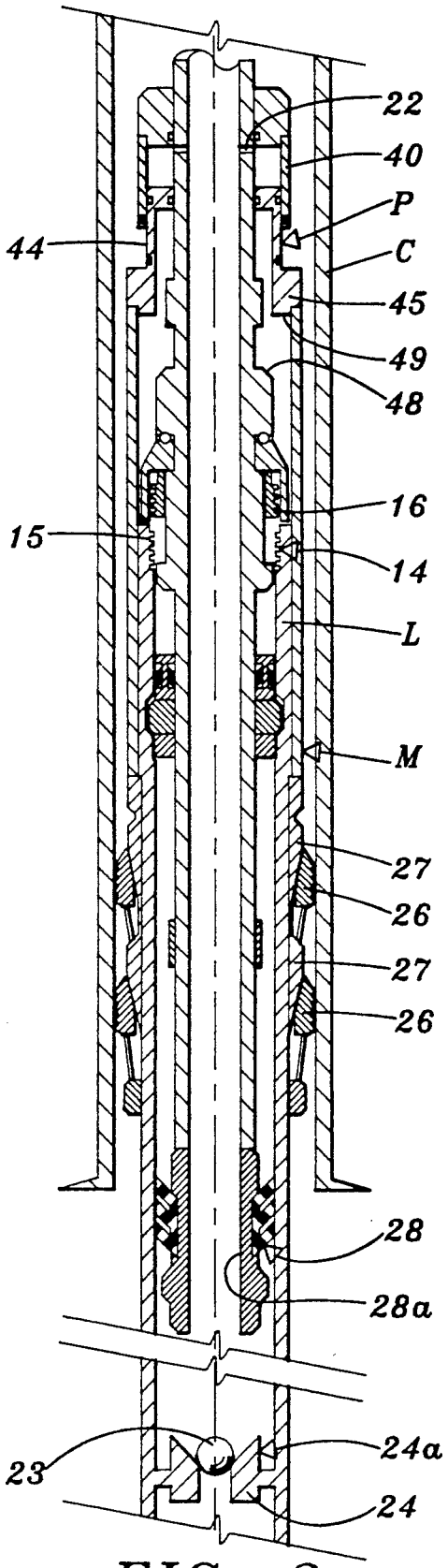
FIG. 2 is a view similar to FIG. 1, but showing the components when the piston has moved the tubular member and cone surface on the liner down to set the slips on the casing and showing a single liner wiper.

The operating string OS is connected adjacent the upper end 20 of the running tool represented generally by the letter T. The tool T includes a mandrel 18 having longitudinal passage or bore 21 therein for conducting fluid through the port 22 in the mandrel 18 to move the piston referred to generally at P when a plug or ball 23 is seated in the seat 24 which is in bore 21 below the port 22 in the setting tool. The seat 24 may be releasably connected in a catcher, represented generally at 24*a*, by a frangible member 24*b*, as better seen in FIG. 8. The catcher 24*a* may be secured in the liner L as shown in FIGS. 2 and 8.

In addition to the setting tool T and piston P, the liner hanger setting arrangement may be generally defined as including the tubular member represented generally at M; longitudinally spaced rows of circumferentially spaced slip segments 26 supported on the liner L; and longitudinally spaced, annular tapered cone surfaces 27 forming a ramp as shown supported on the tubular member M.

When it is desired to set the liner in the casing, the ball 23, or other suitable closure is dropped or pumped in the operating string and setting tool mandrel bore 21 to plug off flow through the bore 21 to direct the fluid pressure through port 22 to act on the top of piston P. Piston P moves tubular member M and cone surfaces 27 down along liner L to engage slip segments 26 and move, or urge them outwardly into securing relation with the casing C as illustrated in FIG. 2. The cone surfaces 27 may be formed on the tubular member M, or they may be formed separately and connected with the tubular member M in any suitable manner as shown in the drawings.

The setting tool T includes a second releasable connection, referred to generally at 14, for releasably connecting the tool T to the liner L to enable the liner and setting tool to be lowered and positioned in the cased well bore. The connection 14 includes threads 15 on the upper bushing UB forming part of liner L which engage with threads 16 on the nut 17. The mandrel 18 is rotatable relative to the liner L by the arrangement , well known in the art, represented generally at A in FIG. 1. The nut 17 is mounted on a non-circular portion of the mandrel 18 of the the setting tool. After the liner has been secured to the casing, the setting tool and operating string can be released from the liner while cementing operations are conducted. The operating string is rotated in a desired manner to rotate the nut 17 and the mandrel 18 relative to the set liner and disconnect the setting tool and the operating string from the liner. The threads on the nut 17 may be left hand or right hand, which ever is preferred, so that the operating string can be rotated as required to release the setting tool from the liner.

Skirt, or portion 40, which is preferably annular, depends from the setting tool upper end 20 and extends longitudinally and is spaced radially from the setting tool to provide a longitudinally extending, radial space 41 between the depending portion 40 and the setting tool mandrel 18 for receiving the annular piston P therein as better seen in FIG. 6. Annular seals 42 and 43 seal between the piston and the setting tool and between the piston and the depending portion to sealably position the piston in the space 41.

Figure 10:
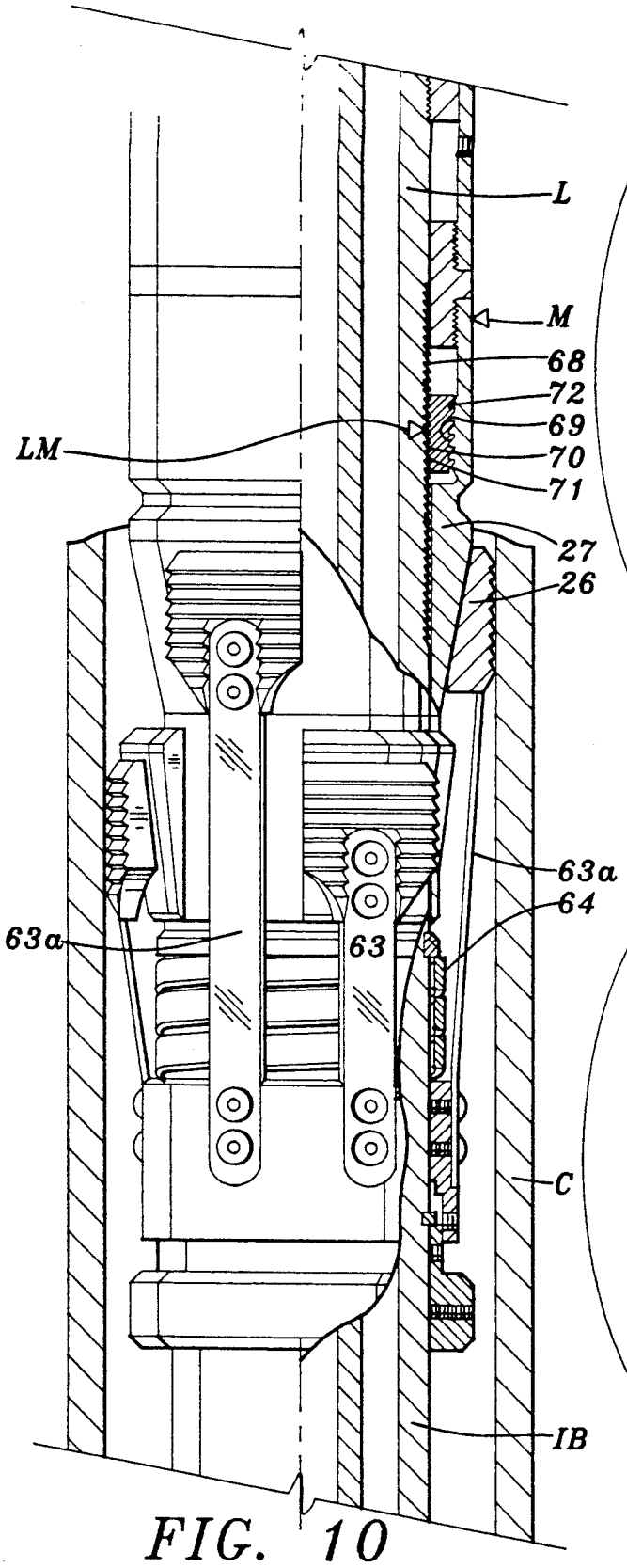
FIG. 10 is a continuation view of FIG. 9 showing the tapered cone surfaces on the tubular member moved down and the slips urged outwardly to engage the liner and one form of the lock means.
Figure 10A:
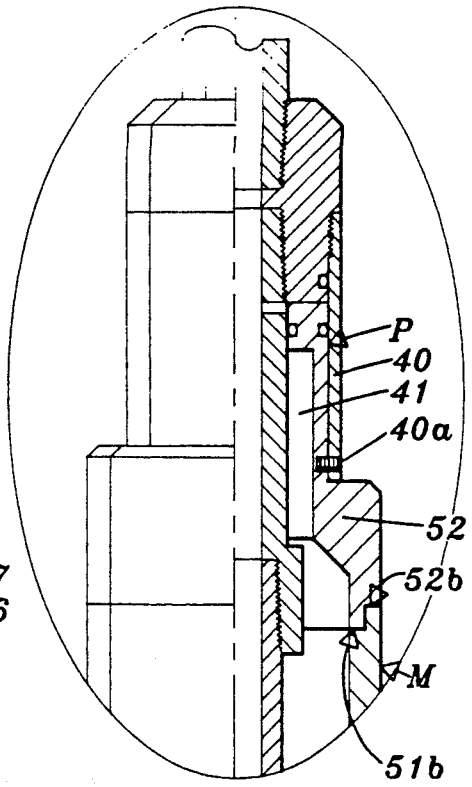
FIG. 10A is a enlargement that shows the piston and an alternate form of the sleeve associated therewith.

The piston P includes an extension 44 depending therefrom which terminates in a laterally extending projection 45, which extends laterally adjacent the lower annular lower end 40*a* of depending portion 40 as shown in FIGS. 6 and 10A. A first releasable connection in the form of a frangible member shown in the form of shear pin 46, extends between the depending portion 40 and the piston P to releasably secure the piston to the setting tool T. After the liner L has been secured to the casing C and cemented, the setting tool and operating string OS are removed from the well bore and as it is moved up in the liner L and casing C by the operating string OS towards the earth's surface, the shoulder 48 on the mandrel 18 of the setting tool T engages the lower end 49 of the projection 45 to carry the piston P from the cased well bore with the setting tool. An engagable surface on Piston P, referred to generally at 50, is provided on the laterally extending projection 45. In the FIG. 6 form the surface 50 is shown in one form as external threads 50*a* on the laterally extending projection 45. The piston and depending skirt configuration may be other than annular, if so desired.

The member M is releasably connected on the liner L by the third releasable connection in the form of shear pin, or frangible member 54. A suitable seal S is provided between the upper bushing UB of the liner L and the tubular member M, as shown in FIG. 1. Suitable seals, where necessary as well known in the art, may be provided between the connected components forming the setting tool T and may be also provided between the connected components forming the liner L.

The member M is a tubular member 51 which may be a tie back receptacle, and in the preferred embodiment the tubular member M extends around liner L and longitudinally from adjacent the piston P to adjacent said slip segments 26. As shown in the drawings, the upper end of tubular member 51 is longitudinally spaced beyond the upper bushing UB at the upper end portion of the liner and the lower end of tubular member 51 terminates adjacent the slip segments 26 as shown in the drawings. A tubular sleeve 52 is associated with piston P and is either integral with piston P as shown in FIG. 10A, or is a separate member as shown in FIG. 6. When separate, it has an upper and a lower end with a surface in the form of threads 53 on its inner diameter adjacent its upper end for engaging external threads 50*a* on lateral extension 45 to releasably 5 connect with the piston. The threads 53 on sleeve 52 may be of greater longitudinal extent than the threads 53*a* on Piston P. This makes it easier for machining purposes and to operatively position the lower tubular member 51 to abut its upper end with the lower end of the sleeve 52 in assembly of the arrangement for lowering into the well bore.

The lower end of the sleeve 52 and the upper end of tubular member may each be provided with a suitable surface, represented generally at 52*b* and 51*b*, respectively, of any desired configuration such as shown in FIG. 6 to assist in maintaining the sleeve 52 on piston P and the tubular member M engaged or interlocked. When the piston P moves down it moves sleeve 52, tubular member M and tapered cone surface or surfaces down to engage and secure the slip segments and liner L with the casing C.

FIG. 10A illustrates another relationship of the Piston P to the tubular member M. Piston P is shown integrally formed with sleeve 52. This form also has configured surface 52*b* adjacent its lower end for engaging surface 51*b* on tubular member 51 to function as previously described.

The inner barrel IB portion of the liner L, in the embodiment shown, supports the slip segments 26. A slip segment support means is referred to generally at 57 and is secured on the liner in longitudinal spaced relation to the the annular cone surface adjacent the lower end of the tubular member M as better shown in FIG. 7. The support means includes an annular member 58 secured on the liner L in any suitable manner, such as by set screws, welding or the like. An annular slip spring body 59 is releasably secured on the member 58. Longitudinally extending slip springs 60 have first ends, or end portions, 61 which are secured to the annular ring 61*a* in any suitable manner, such as by welding or the like which ring 61*a* abuts the lower annular shoulder 58*d* adjacent the lower end of slip spring body 59. The slip springs 60 are releasably connected to the slip spring annular body 59 in any suitable manner such as by screws or the like as shown in the drawings and extend longitudinally along the liner toward the cone surfaces 27 as shown in the drawings to terminate in second end portions 62 on which are mounted slip segments 26.

Figure 7:
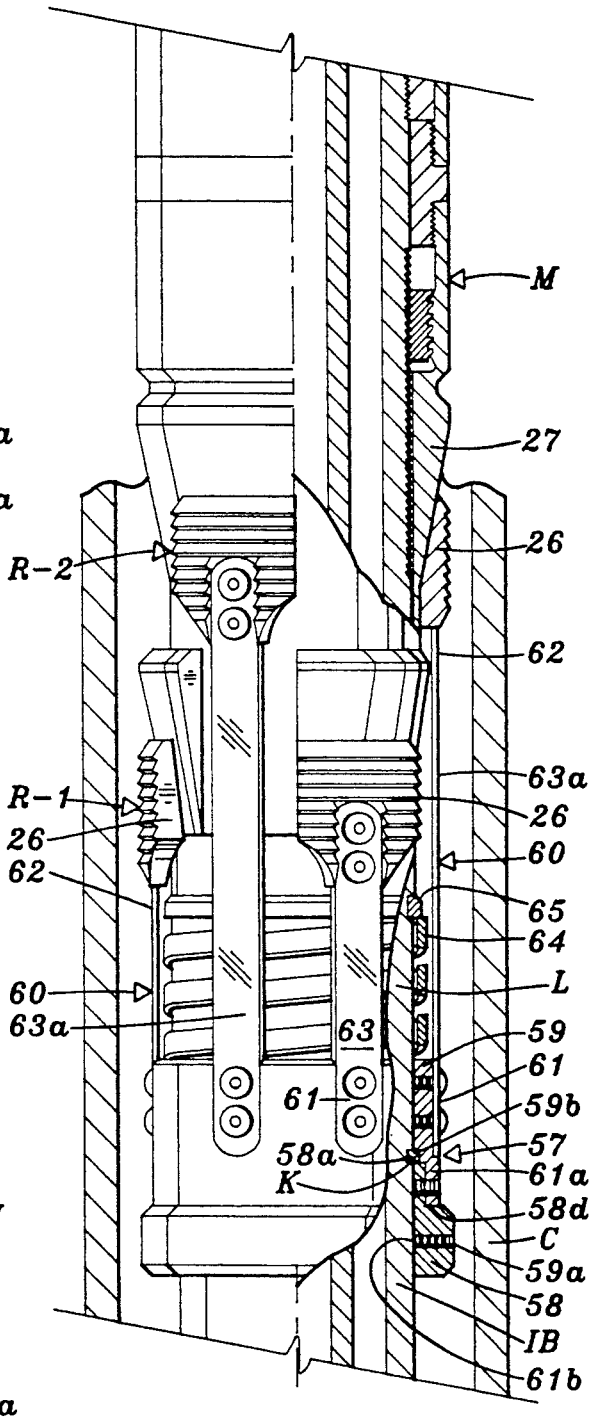
FIG. 7 is a quarter sectional view continuation of FIG. 6.

The slip springs 63 for a row of slip segments, designated generally R-1 in the drawings are circumferentially spaced around and secured to the annular ring 61*a* and slip spring body 59 in a manner well known in the art to support the slip segments 26 in circumferential spaced relation. Where additional rows of slip segments, such as a second row by way of example only, generally designated R-2 is to be employed, the slip springs 63*a* for the second row of slip segments are of greater longitudinal extent to accommodate the circumferential spacing of the second row of slip segments, as shown in FIG. 7 of the drawings, so that both rows of slip segments may engage with their respective annular tapered cone or ramp surface on the tubular member without interfering with each other. The slip springs 61 and additional slip springs 63 for the slips of each row of slip segments to be employed are engaged with the slip spring body 59 and the ring 61*a* by suitable means such as screws as shown in the drawings FIGS. 7, 10, 12 and 13.

The ring 61*a* is releasably secured to the annular body 58 by suitable means such as shear pins 61*b* or the like. The annular body 58 is locked on the liner L by suitable means such as set screws 59*a* or other suitable means. A key way 58*a* is provided in the liner adjacent the upper end of the annular member 58 and a cooperating key way 59*b* is provided on the lower inner surface of slip spring body 59 adjacent its lower end as shown in FIG. 7. A keeper ring K is positioned in the keyways 58*a*, 59*b* to assist in retaining annular member 58 in position if the liner L shifts down, as will be explained hereinafter.

Where a spring such as shown at 64 in FIG. 7 is employed with the slip support means, an annular shoulder 65 may be secured or formed on the liner L in longitudinal spaced relation to slip spring body 59 with one end of the spring 64 abutting the slip spring body 59 and the other end abutting the annular shoulder. This tends to maintain the slip segments in non engaging relation with the cone surface while lowering the operating string OS and liner hanging arrrangement into positiion in the casing.

When it is desired to set the liner in the casing, a ball or closure 23 is dropped or pumped down the operating string and setting tool T to seat as shown in FIGS. 1 or 2. Pressure is applied at the surface by any well known means inside the operating string OS to shear the pin 46 and move piston P down to engage upper sleeve portion 52 with tubular portion 51 of the member M to move member M down. This shears pin 54 and movement of member M moves tapered cone or ramp surfaces 27 down underneath slip segments 26 and urges them outwardly into engagement with the casing C. When the slips are in the set position, a pressure increase is noted at the earth's surface since the piston and tubular member M with the cone surfaces thereon can no longer move downward. The pressure at the surface can be released and the operating string OS lowered to confirm that the slips are set into the casing C, which is verified by a loss of weight on the weight indicator at the earth's surface.

Figure 13:
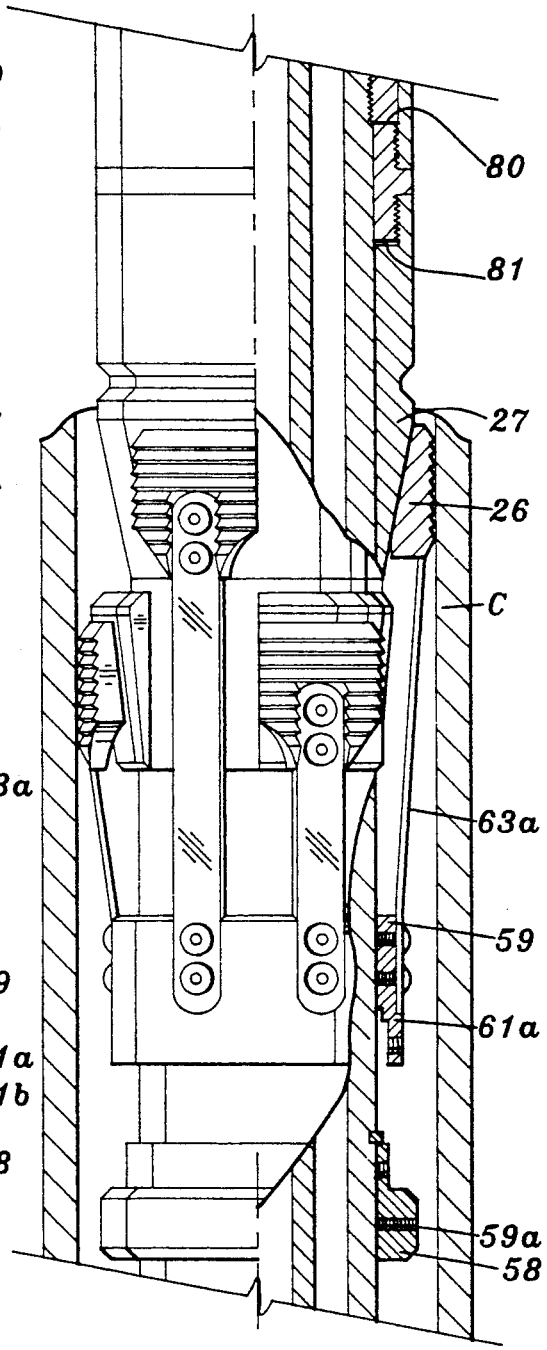

If the weight of the liner L and tubular member M, which are locked together by lock means LM, causes the slips to move slightly to bite into or penetrate into the casing wag, the shear pins 61*b* may shear permitting the liner L and tubular member M, to shift downwardly as shown in FIGS. 10 and 13.

Figure 11:
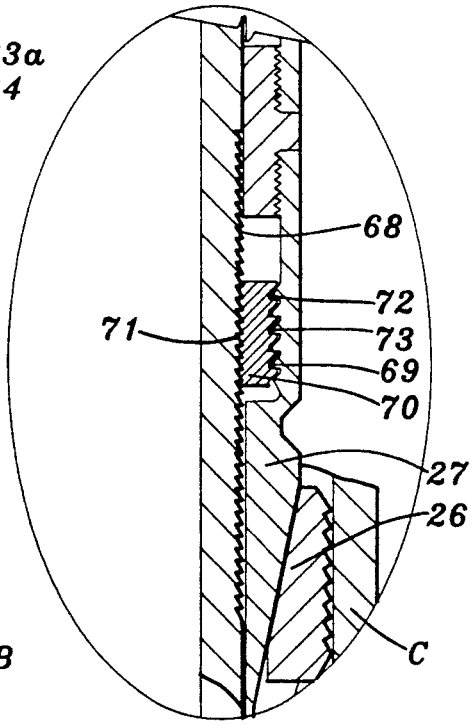
FIG. 11 is an enlarged view of a form of the lock means shown in FIG. 10 to maintain the tubular member and liner engaged when the tubular member has been lowered to abut the cone surfaces thereon with the slip segments to secure the liner to the casing.

One form of a lock means is represented generally at LM and assists in maintaining the tubular body and liner in relation to each other after the slips have engaged with the casing C as shown in FIGS. 10 and 11 and to maintain the slips secured with the casing. The lock means includes a longitudinally extending ratchet surface 68 on the liner L and a longitudinally extending ratchet surface 69 on the tubular member M with a split ratchet ring 70 having an inner and an outer circumferential configured ratchet surface 71,72, for fitting between the liner and the outer tubular member respectively which surfaces 71,72 are configured to conform with the ratchet surfaces 68,69, respectively. As shown in the preferred embodiment, the ratchet surface 69 on the tubular member M engages with the ratchet surface 72 on the split ring 70 and as the tubular member M moves down in response to movement of the piston P, the split ratchet ring also moves down with the tubular member. There is sufficient clearance, as better shown and represented at 73 in FIG. 11, for the split ring 70 to expand and move out of engagement with the ratchet surface 68 on the liner L as the ring 70 is moved down toward and over the crest of the threads forming the ratchet surface on the liner L, whereupon the ring 70 collapses back into engagement with the threads forming the ratchet surface 68 on the liner. The step wise expansion and retraction of the split ring 70 is continued as the tubular member is moved down until the tubular member M and the cone surfaces thereon have moved down sufficiently to urge the slips 26 into firm engagement with the casing. The split ring 70 will remain locked to the liner L and tubular member M in its final position because of the configuration of the surfaces 68, 69, 71 and 72.

Figure 12:
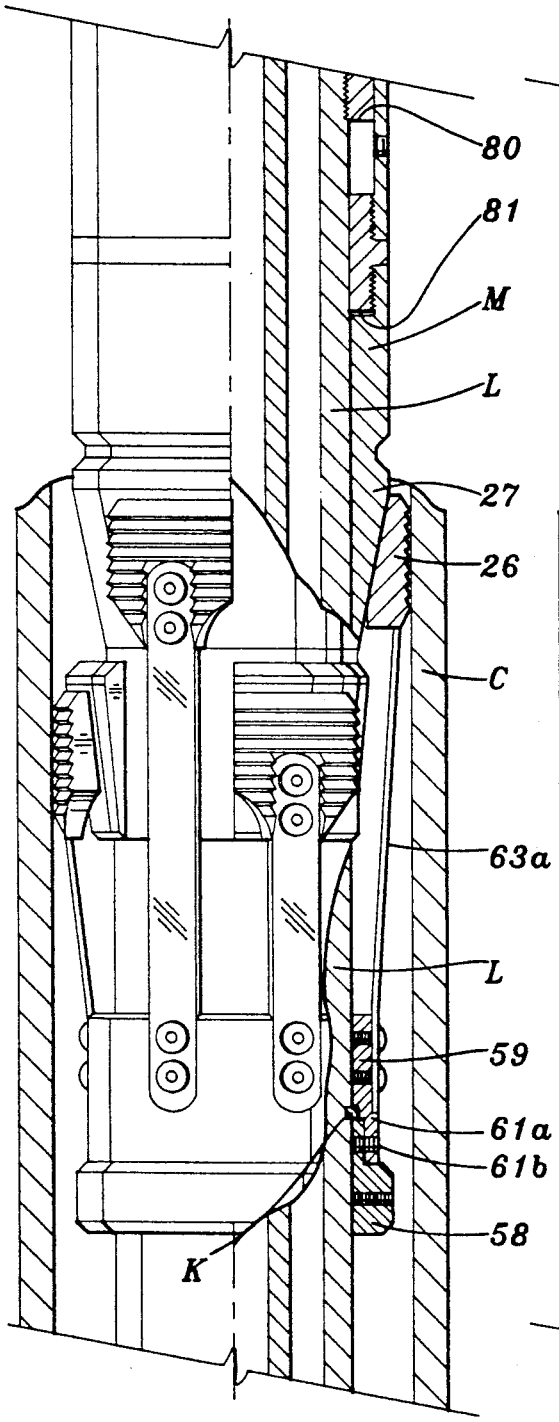
FIGS. 12 and 13 show an alternate form of lock means to retain the slips and cones engaged.

An alternate form of lock means may be employed instead of the ratchet arrangement above described where no spring 64 is employed as shown in FIGS. 12 and 13. After the slips 26 have been urged into engagement with the interior of the casing C, the pressure increase at the earth's surface will again be noted and while this pressure is maintained, the operating string OT and liner L may be gradually lowered or slacked off and the liner weight will shift the liner L down relative to tubular member M. This shears pin **61*b* since annular member 58 moves down with liner L, and the exterior shoulder 80 on liner L moves down with the liner and engages the inwardly projecting shoulder 81 on the tubular member M and may move the tubular member M down. The engagement of the liner shoulder 80 with tubular member shoulder 81 transfers the weight of the liner to the tubular member cone surfaces and against the slips 26 to cause the slips 26** to bite into the casing. This also utilizes the weight of the liner L to lock and maintain the liner and the tubular member together in the lowermost position of the tubular member and secure the slips and cones when the slips are secured with the casing.

The seal means SM includes an annular body 82 which supports suitable seals 83,84 to engage with the interior of the upper bushing of the liner L and the exterior of the well tool, respectively, as shown in FIG. 6 for sealing therebetween. Cooperating surface means on the liner L in the form of an annular recess or profile 85, the annular surface 86 on the operating string, the cooperating surfaces 88, 89 on the movable member 90 cooperate to lock the seal means SM in position between the tool T and the liner L, while accommodating axial movement of the setting tool relative to the seal means and the liner. A movable member 90 is retained by a pin 92 in each circumferentially spaced window 91 in the body 82. The opening **82*a* in the body 82 through which the pin 92 extends enables member 90 to move into the recess or profile 85 when the surface 86 of the tool is adjacent the surface 88 of the body 82. When it is desired to remove the setting tool, the mandrel 18 is shifted upwardly to position a smaller external diameter portion of the mandrel adjacent the seal means SM so that the seal means may release from the recess 86. When shoulder 48*a*, which is on a smaller external diameter portion of the mandrel 18 of tool T than the mandrel portion which is adjacent the seal means when the seal means SM is in sealing relation, is moved upwardly with tool T, it engages the bottom surface of the body 82** and moves the movable member out of the recess so that the seal means SM may be retrieved to the earth's surface with the setting tool. If desired, the seal means SM may be of the swab cup type or the drillable type instead of the retrievable type.

Where the liner is to be cemented in the well bore, the setting tool T and the other componets of the arrangement shown in the drawings are assembled for lowering into the well bore. The liner is secured or set on the casing as previously described. The setting tool T is then released by the releasable connection 14 from the liner L and its components which have been set in the casing so that if a malfunction occurs during the cementing, the operating string and tool T will not be subject to as great a risk of loss in the well bore.

In FIG. 2 a single liner wiper referred to generally at 28 is shown having a bore **28*a* with a surface configured in a manner well known in the art for receiving and latching in the bore 28*a* a pump down plug pumped down the operating string in a manner well known in the art for moving ahead of cement pumped down the operating string to be discharged out the lower end of the liner into the well bore. The single liner wiper may be connected or positioned relative to the operating string in a manner well known in the art. The seat 24 is released from catcher 24*a* by pressure in the setting tool and liner. When the pressure in the operating string disconnects the liner wiper and the plug therein from the operating string, the engaged plug and liner wiper move through the liner and seat in the catcher. Pressure then disengages the plug from the wiper and it moves to a lower part of the liner wiper as shown in FIG. 4, and the wiper body has ports 28*c*** to enable the cement to flow therethrough and into the cased well bore.

Figure 4:
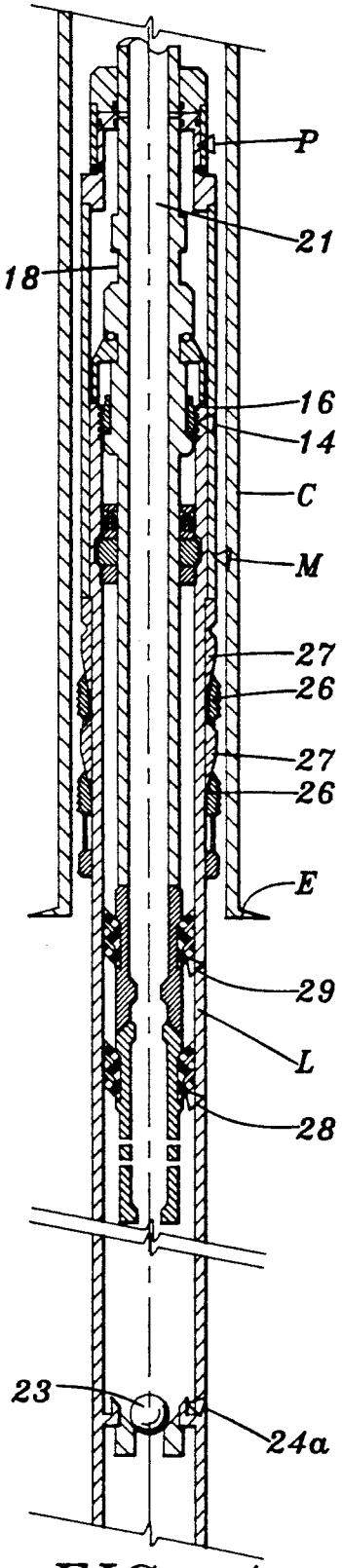
FIG. 4 is a view similar to FIG. 3, but with the tapered cone surfaces and slips engaged to secure the liner to the casing. The lower liner wiper is shown released from its position relative to the operating string and moved to engage in the catcher adjacent the lower end of the liner and the pump down plug released in the lower liner wiper for circulating cement from the liner to the well bore and the upper liner wiper has the upper plug engaged therewith.
Figure 5:
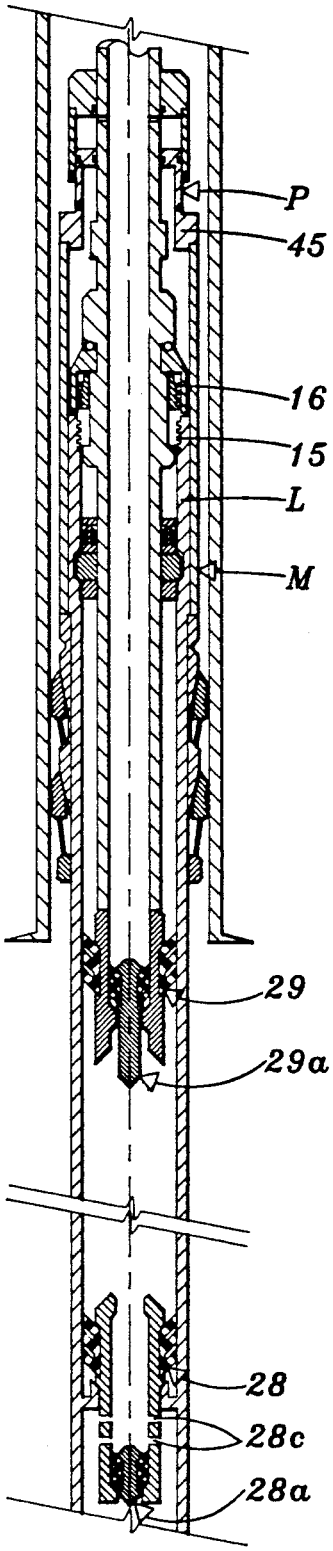
FIG. 5 shows the next sequence of the relationship of the liner hanger setting arrangement after FIG. 4 and shows the upper liner liner wiper and the upper pump down plug therein latched with the lower liner wiper in the catcher.
Figure 3:
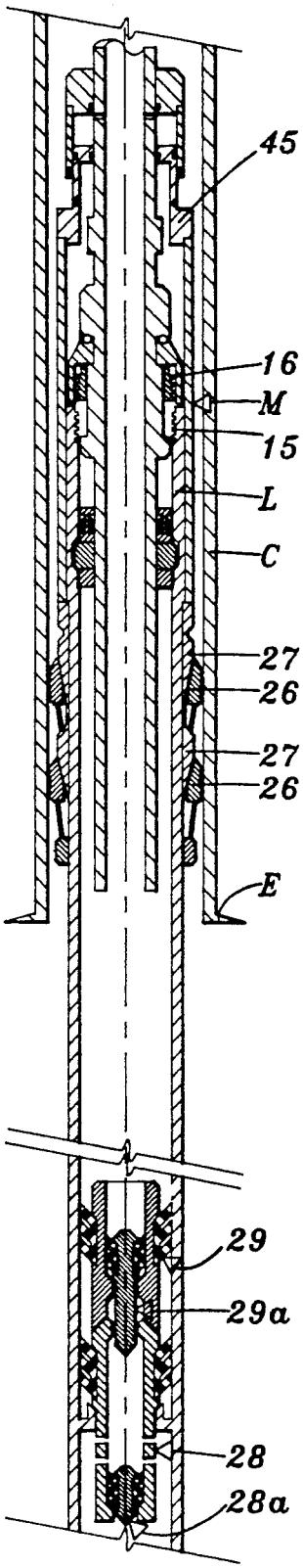
FIG. 3 is a view similar to FIG. 1 with upper and lower liner wipers for use when cementing the liner.

FIGS. 3–5 show lower and upper liner wipers referred to generally at 28 and 29 which are associated with each other and related to the operating string OS to be supported thereby and to each receive and latch with a lower pump down plug and an upper pump down plug, respectively, stepwise placed in the operating string and pumped down ahead of and behind the cement in a manner well known in the art, The lower pump down plug wipes the operating string ahead of the cement and the upper pump down plug wipes the operating string behind the cement. When the lower plug latches and seats with the lower liner wiper, they both disconnect from their position relative to the operating string by pressure in the operating string and move through the liner ahead of the cement to form a wiping seal in response to pressure until the catcher **24*a* is reached in the lower part of the liner. It can be appreciated that the pressure in the setting tool bore 21 will have been previously increased to shear pin 24b, shown in FIG. 8, which supports seat 24 in catcher 24a, so that the ball 23 and seat 24 fall out of catcher 24a to the bottom of the liner or into the well bore. This permits the latch surface on the lower liner wiper which is like the latch surface 30 on the single wiper shown in FIG. 8 to engage with the latch surface 31 in the catcher 24a to retain the liner wiper therein, whether it is a single plug arrangement or the dual plug arrangement of FIGS. 3–5**.

When the dual liner wiper and pump down plug arrangement schematically shown in FIGS. 3–5 is used in cementing, the lower liner wiper first releases along with its pump down plug and engages in the latch surface 31 of catcher 24a. Whether it is a single wiper or a dual wiper arrangement, a pressure increase in the operating string bore 21 and liner L causes the pump down plug to release from the liner wiper first positioned in the catcher 24a and ports 28c as shown in FIG. 4 of the seated liner wiper enable the cement to flow from the liner to the well bore. Where the dual wiper arrangement is employed, the upper wiper receives its pump down plug and then, upon pressure increase, releases from its position relative to the operating string and moves down until either the pump down plug or the liner wiper engage with either the catcher 24a or the lower liner wiper in the catcher 24a to seal off or form a blocking valve to prevent undesired communication between the well bore and the liner.

The foregoing description of the invention are illustrative and explanatory thereof, and various changes in the details of the illustrated construction may be made without departing from the spirit of the invention.

What is claimed is:

1. A hydraulically actuated liner hanger arrangement for use with an operating string to secure a liner on a casing in a well bore, said arrangement including:

a setting tool having an upper end for connection with the operating string;

a piston;

said setting tool having a passage therein to communicate fluid to move said piston longitudinally;

slip segments;

slip segment support means supporting said slip segments on the liner for movement toward the casing;

a tubular member engageable by said piston for downward movement longitudinally relative to said liner;

at least one cone surface on said tubular member for movement therewith to urge said slip segments into engagement with the casing for securing the liner thereto a first releasable connection for releasably connecting said piston to said setting tool;

a second releasable connection for releasably connecting the liner to said setting tool;

a third releasable connection for releasably connecting said tubular member to the liner;

said setting tool including a depending portion which depending portion extends longitudinally of and is spaced radially from said setting tool to provide a longitudinally extending radial space between said depending portion and said setting tool for receiving said piston therein;

seals between said piston and said setting tool and between said piston and said setting tool depending portion to sealably position said piston in said radial space;

said depending portion having a lower end;

said piston including an extension depending therefrom;

said piston extension terminating in a laterally extending projection which extends laterally adjacent said depending portion lower end;

said first releasable connection extending between said depending portion and said piston extension;

said tubular member having an upper and a lower end;

a tubular sleeve on said piston for engaging said tubular member to push it down when said piston is moved down; and a lock to secure said at least one cone surface and slip segments engaged when said slip segments are engaged with the casing.

2. The arrangement of claim 1 wherein:

said first releasable connection is a frangible member; and said second releasable member is a threaded connection between the liner and said setting tool.

3. The arrangement of claim 1 wherein said third releasable connection is a frangible member.

4. The arrangement of claim 1 wherein said sleeve is threadedly secured with said piston.

5. The arrangement of claim 1 wherein said sleeve is integrally formed with said piston.

6. The arrangement of claims 1 wherein: said tubular sleeve has a lower end;

a surface on said tubular sleeve lower end; and a surface on said tubular member upper end for engaging with said surface on said tubular sleeve lower end.

7. The arrangement of claim 1 wherein:

said depending portion surrounds said body to provide an annular radial space;

said piston is an annular piston sealably positioned in the radial space between said body depending portion and said body.

8. The arrangement of claim 1 wherein said lock includes:

a longitudinally extending ratchet surface on the liner;

a longitudinally extending ratchet surface on said tubular member;

a split ratchet ring having an inner and an outer periphery for fitting between said liner ratchet surface and said tubular member ratchet surface;

said ratchet ring inner periphery having a ratchet surface thereon for engaging with said ratchet surface on said liner; and said ratchet ring outer periphery having a ratchet surface thereon for engaging with said ratchet surface on said cone segments whereby as said tubular member is moved longitudinally relative to said liner, said ratchet ring moves longitudinally therewith and expands radially to move along said ratchet surface on said liner until said slip segments engage said liner whereupon said ratchet ring inner and outer periphery ratchet surfaces and said liner and tubular member ratchet surfaces cooperate to maintain said slips and cone surfaces in engaged relationship.

9. The arrangement of claim 1 wherein said lock includes cooperating surfaces on the liner and said tubular member which abut when said slip segments and said at least one cone surface are engaged when said slip segments are engaged with said casing.

10. The arrangement of claim 1 wherein said slip segment support means includes:

a slip spring body on the liner;

slip springs having a first end connected with said slip spring body to extend said slip springs longitudinally from said slip spring body; and said slip springs having a second end for connection with said slip segments.

11. The arrangement of claim 10 wherein said slip segment support means further includes:

an annular member secured on the liner;

an annular shoulder on the liner spaced longitudinally from said annular member; and a spring on the liner extending between said annular member and said annular shoulder.

12. The arrangement of claim 10 wherein said slip spring body is releasably secured on said annular member by a frangible member.

13. The arrangement of claim 4 wherein said threaded connection between the liner and said setting tool includes a threaded surface on the liner;

a nut supported on said setting tool for rotation with and longitudinally movable relative to said setting tool; and an exterior threaded surface on said nut engageable with said threaded surface on the liner whereby said setting tool may be disconnected from the liner by rotation to disconnect said nut from the liner.

14. The arrangement of claim 2 wherein said tubular member extends longitudinally from adjacent said tubular sleeve and surrounds the liner to adjacent said slip segments.

15. The arrangement of claim 1 including seal means between said tubular member and the liner.

16. The arrangement of claim 1 including seal means between said setting tool and the liner.

17. The arrangement of claim 16 wherein said seal means includes:

a seal body for fitting between said setting tool and the liner;

seal means on said setting tool for engaging the liner and said setting tool to seal there between;

cooperating surfaces on the liner, said seal body and said setting tool engageable to lock said seal body to the liner for sealing between the liner and said setting tool while accommodating axial movement of said setting tool, said cooperating surfaces including a recess in the liner, a projection on said seal body engageable in the liner recess and surface on said setting tool to urge said projection into the recess in the liner to maintain said projection engaged in the liner recess.

18. The arrangement of claim 17 including means to unlock said cooperating surfaces on the liner and said seal body from each other upon a predetermined amount of relative longitudinal movement between said setting string and said seal body whereby said seal body may be retrieved with said setting tool from the well bore, said means to unlock including additional surface means on said setting tool which engages said seal body when said setting tool is moved longitudinally a predetermined amount relative to said seal body to release said seal body from the liner.

19. A hydraulically actuated liner hanger arrangement for use with an operating string to secure a liner on a casing in a well bore, said arrangement including:

a setting tool for connection with the operating string;

a piston;

said setting tool having a passage therein to communicate fluid to move said piston longitudinally downwardly to secure the liner on the casing;

slip segments supported on the liner for movement toward the casing;

at least one cone surface supported on the liner for downward movement in response to movement of said piston to urge said slip segments in engagement with the casing;

a releasable connection connecting said setting tool with the liner;

seal means between said setting tool and the liner;

wiper means releasably connected to said setting tool for wiping the liner ahead of cement conducted through the operating string and liner to the wall bore;

plug means for wiping the operating string ahead of cement conducted there through and engageable with said wiper means before said wiper means moves through the liner;

said wiper means includes upper and lower longitudinally spaced wiper means releasably connected to said setting tool;

upper and lower plug means for wiping the operating string, respectively, ahead of and behind cement conducted there through, said upper and lower plug means engageable, respectively, with said upper and lower wiper means to move through the liner ahead of and behind the cement;

a catcher in the liner;

a latch for securing the lower wiper means with said catcher; and a latch for securing the upper wiper and plug and lower wiper together in said catcher to block off flow between the liner and the well bore.

20. A liner hanger for detachably securing to a setting tool having a port therein for communicating fluid with a piston to move it and secure a liner in a cased well bore, said liner hanger comprising:

slip segments supported on the liner for movement toward the casing;

cone surface means movably supported on the liner for downward movement in response to movement of the piston to urge said slip segments in engagement with the casing;

a tubular member supported on the liner for moving the cone segments down on the liner in response to movement of the piston;

a releasable connection securing said tubular member on the liner;

a seal between said tubular member and the liner;

the liner having an upper and a lower end;

said tubular member extending longitudinally beyond the upper end of the liner and surrounding the liner to adjacent said slip segments;

a slip spring body on the liner;

slip springs having a first end connected with said slip spring body to extend said slip springs longitudinally from said slip spring body;

said slip springs having a second end for connection with said slip segments;

an annular shoulder on the liner spaced longitudinally from said slip spring body;

a spring on the liner extending between said slip spring body and said annular shoulder;

a frangible member releasably securing said slip spring body on said annular member.

21. The method of hydraulically setting a liner hanger in a well casing by a setting tool releasably connected with the liner hanger, the setting tool having a port communicating with a passage in the setting tool for conducting fluid to a piston in the setting tool to move cone means on a tubular member on the liner down to urge slip means supported on the liner into engagement with the well casing, comprising the steps of:

positioning seal means on the setting tool to seal between the setting tool and the liner;

releasably connecting the setting tool with the liner and positioning the seal means to seal between the liner and the setting tool;

conducting fluid through the port in the setting tool to move the piston, the tubular member and the cone means on the liner downwardly to urge the slip means on the liner outwardly to secure with the well casing;

disengaging the piston from the tubular member and removing it with the setting tool from the liner; and locking the tubular member with the liner when the slip means is secured with the liner.

22. The method of hydraulically setting a liner hanger with a liner having a catcher therein in a well casing in a well bore by a setting tool that is supported by an operating string for cementing the liner in the well casing wherein the setting tool is releasably connected with the liner hanger, the setting tool having a port communicating with a passage therein for conducting fluid to a piston in the setting tool to move cone means on a tubular member on the liner down to urge slip means supported n the liner into engagement with the well casing and liner wiper means releasably supported on the operating string for receiving plug means therein to move ahead of the cement, comprising the steps of:

positioning seal means on the setting tool to seal between the setting tool and the liner;

positioning the liner wiper means adjacent the lower end of the operating string;

releasably connecting the setting tool with the liner and positioning the seal means to seal between the liner and the setting tool;

conducting fluid through the port in the setting tool to move the piston, the tubular member and the cone means on the liner downwardly to urge the slip means on the liner outwardly into engagement with the well casing;

disconnecting the setting tool from the liner and disengaging the piston from the tubular member;

placing the plug means in the operating string and discharging the desired volume of cement into the operating string; and pumping the plug means ahead of the cement down the operating string with the cement to seat the plug means in the liner wiper means;

moving the engaged liner wiper means and plug means through the liner with the cement;

seating the liner wiper means in the catcher;

separating the plug means from the liner wiper means; and discharging the cement from the liner into the well bore.

23. The method of hydraulically setting a liner hanger with a liner having a catcher therein in a well casing in a well bore by a setting tool that is supported by an operating string for cementing the liner int he well casing wherein the setting tool is releasably connected with the liner hanger, the setting tool having a port communicating with a passage therein for conducting fluid to a piston in the setting tool to move cone means on a tubular member on the liner down to urge slip means supported on the liner into engagement with the well casing and upper and lower liner wiper means releasably supported for receiving, respectively, upper and lower plug means therein to move ahead of and behind the cement, comprising the steps of:

positioning seal means on the setting tool to seal between the setting tool and the liner;

positioning the upper and lower liner wiper means adjacent the lower end of the operating string;

releasably connecting the setting tool with the liner and positioning the seal means to seal between the liner and the setting tool;

conducting fluid through the port in the setting tool to move the piston, the tubular member and the cone means on the liner downwardly to urge the slip means on the liner outwardly into engagement with the well casing;

disconnecting the setting tool from the liner and disengaging the piston from the tubular member;

placing the lower plug means in the operating string and discharging the desired volume of cement into the operating string; and placing the upper plug means in the operating sting after the cement;

pumping the upper and lower plug means ahead of and behind, respectively, the cement down the operating string to first seat the lower plug means in the lower liner wiper means;

moving the engaged lower liner wiper and the lower plug therein through the liner ahead of the cement;

seating the upper plug in the upper liner wiper;

moving the engaged upper liner wiper and the upper plug therein through the liner behind the cement;

seating the lower liner wiper means and engaged plug in the catcher;

separating the lower plug means from the lower liner wiper means;

discharging the cement from the liner into the well bore;

moving the engaged upper liner wiper means and upper plug means through the liner behind the cement;

positioning the upper liner wiper and plug means with the lower liner wiper in the catcher;

separating the plug means from the liner wiper means; and discharging the cement from the liner into the well bore.

24. The method of claim 23 wherein the liner is provided with a catcher and including the further steps of:

securing the lower liner wiper in the catcher and releasing the first plug therefrom for discharging the cement into the well casing; and securing the upper liner wiper and the upper plug therein in the catcher with the lower liner wiper.

25. A setting tool for securing a liner to a casing in a well bore by moving a tubular member on the liner down to engage slips on the liner and urge them outwardly to secure with the casing, said setting tool comprising:

a mandrel;

a piston on the setting tool movable downwardly to move the tubular member downwardly to set the slips;

said mandrel having a port to conduct fluid to move said piston and the tubular member down to secure the slips on the liner with the casing means releasably supporting said piston on the setting tool;

a releasable connection for releasably connecting said setting tool to the liner; and a seal on the setting tool sealably engaging the liner.

26. The setting tool of claim 25 wherein said seal is retrievable from the well bore with the setting tool.

27. The setting tool of claim 22 including a tubular sleeve on said piston for engaging and moving the tubular member down.

28. The setting tool of claim 27 wherein said tubular sleeve is integrally formed with said piston.

29. The setting tool of claim 28 wherein said tubular sleeve is releasably connected to said piston.

30. The setting tool of claim 29 wherein said tubular member has threads thereon and said piston has threads thereon for releasably connecting said piston and tubular sleeve together.

* * * * *